United States Patent [19]

Hebert et al.

[11] Patent Number: 4,799,447

[45] Date of Patent: Jan. 24, 1989

[54] PORTABLE BOARDING PLATFORM

[76] Inventors: Gary Hebert, 9489 Affirmed La., Boca Raton, Fla. 33434; Stacey Leone, 340 NE. 43rd Ct., Ft. Lauderdale, Fla. 33334

[21] Appl. No.: 46,576

[22] Filed: May 6, 1987

[51] Int. Cl.[4] ..... B63B 29/26; E01D 1/00

[52] U.S. Cl. ..... 114/362

[58] Field of Search ..... 114/343, 362, 364; 182/53, 55, 61, 62, 150, 83, 86, 91, 92; 24/639, 598, 610–630

[56] References Cited

U.S. PATENT DOCUMENTS

| | | | |
|---|---|---|---|
| 255,327 | 3/1882 | Owen | 114/362 |
| 941,096 | 11/1909 | Pugatksy et al. | 24/639 |
| 2,420,635 | 5/1947 | Workman | 182/61 |
| 3,158,223 | 11/1964 | Brown | 182/150 |
| 3,195,680 | 7/1965 | Thornburg | 182/92 |
| 3,587,123 | 7/1971 | O'Boyle | 9/400 |
| 3,774,720 | 11/1973 | Hovey | 182/91 |
| 3,892,290 | 7/1975 | Lang | 182/22 |
| 4,462,485 | 6/1984 | Terry | 182/84 |
| 4,495,883 | 1/1985 | Hoy | 114/343 |
| 4,538,314 | 9/1985 | Baranowski | 114/362 |

FOREIGN PATENT DOCUMENTS

| | | | |
|---|---|---|---|
| 1348994 | 12/1963 | France | 182/55 |

*Primary Examiner*—Joseph F. Peters, Jr.
*Assistant Examiner*—Edwin L. Swinehart

[57] ABSTRACT

A true marine portable boarding platform for the sides of boat hulls and boat transoms that attach to the topside of a hull, gunwale or deck of a boat and also provide three dimensional adjustments for adapting to the various boat designs of different boat manufactuers. The boarding platform consists of wooden planking attached to a stainless steel tubular frame having a padded bumper bar. The platform frame is hinged to the telescopic side sections of a supporting carrier bar in such a way as to allow the platform to fold up within the adjusting tubular framework of the carrier bar. The platform's flexible mounting assembly includes (1) a pair of hangar brackets that are swingably attached to the upper sections of the carrier bar and (2) a pair of self-locking deck plates that are insertibly engaged by the adjusting notched pins located on the opposite inboard ends of the hangar brackets. An independent portable ladder is also provided attaching freely and securely between the wooden slats and the platform's tubular frame and resting slightly outward on the lower section of the carrier bar. For the first time, boat owners now have a choice of type, size and placement of a platform for their boat.

20 Claims, 4 Drawing Sheets

PORTABLE BOARDING PLATFORM

BACKGROUND

1. Field of Invention

This invention relates broadly to boat boarding equipment being mounted to the side of a boat hull or boat transom in safely assisting persons in and out of the water or embarking and disembarking a boat from a dock or other boat.

More specifically, it concerns a specially designed complete all purpose portable platform for fisherman, divers and pleasure boaters providing this long awaited need of portability, safety, rigidness, mounting flexibility, ease of use, strength, and easy storage for use as a swimming, diving, standing, and working platform.

2. Description of Prior Art

Boat owners are continually searching for a practical full size safety boarding platform.

Various types are used in the boating Industry such as (1) Fixed transom platforms,
(2) Hinged transom platforms,
(3) Miniture step ladder platforms and
(4) widely unacceptable platforms that boatowners make and attach to the sides, gunwales or transoms of their boats.

The permanently fixed transom boarding platform offers a rigid and stable structure but cannot have any outboard width or lie at the water line for swimmers, divers, and skiers because of engine interference and water drag while planing.

The hinged transom boarding platform loses rigidness, but folds up against the transom, clips and has dangling wires or chains. Most inboard/outboard boats install this full size type, but engine outdrive area still interferes.

Outboard engine boats can only install a miniature step ladder platform to fit on a transom either on the port side or the starboard side of the engine. The Limited space available here, will determine the type and size of this platform. Boating safety is comprised again for access must be in the area of the engine propeller, no safety rails or hold bar, inadequate foot room.

All transom attached boarding platforms make access in and out of a boat very difficult because one must cross over the stern area avoiding bait wells, various deck hardware, engines, engine wells, batteries, cables and electrical wiring.

Boarding platforms that attach to the sides, gunwales or transoms by brackets, hinges, or pins, become detracted from wide acceptance by users and manufactures because of disadvantages including (1) crude design,
(2) bulkyness,
(3) weight factors,
(4) protruding hardware,
(5) storage limitations and
(6) inadequate attachment.

More particularly, most of these homemade boarding platforms that have been proposed are loosely hinged and unstable, making it very difficult to maintain balance while accessing the boat in normal seas.

These same boarding platforms have wires or chains supporting the platform, thus, everytime a boat rolls or pitches, the platform bounces loosely up and down continuously, henceforth, endangering the head and shoulder areas of a swimmer, diver or skier swimming upon the platform.

Boat owners do not have a choice of platforms to use or a preferred location to install one. His boat is limited to transom space, a boat manufacturing design, fixed deck hardware, and storing.

In Summary, true marine use commands circular design strategies and safety techniques for reasons of wetness, slippery surfaces, and the motions of a boat.

One cannot afford to lose balance from lack of safety rails, loose footings, shakiness, and awkward positions subjecting themselves to being thrust against wires, chains, square angles, protruding objects, pins, hooks, various marine engines, transom cutouts and hull edges and various other poorly designed platform items.

OBJECTS AND ADVANTAGES

It is the object of the present invention to adapt to a marine design concept. This distinction is centered around tubular construction, circular parts, rounded edges, flat surfaces, light weight, compactness, stability and ease of use.

More specifically, it is an object of the present invention to provide this marine concept in combination within the structured development and functional use of our newly designed portable boarding platform.

Accordingly, we claim the following as further objects and advantages of the invention:

1. Objects of the safety features.
   (a) A waterline holding bar—where swimmers, divers and skiers can finally have a hand rail to hold on to for staying at or near the boat while in the water away from engine propellers.
   (b) Safety rails or hand rails for accessing the platform from the water, where one can now pull oneself up and step up on the ladder simultaneously, thus, maintaining balance and stability. A person is now prevented from falling off the platform accidently while standing.
   (c) Safety holdbar—while standing on the platform and getting into or out of the boat, this bar provides the holder to achieve balance and stability in various seas.
2. Objects of adapting to various boat designs of different manufacturers.
   (a) Vertical adjustments - one can place this boarding platform to any position at the side of a boat hull, freeboard or transom.
   (b) Outboard adjustment - one can adjust the platform the the hull angle and adapt to various widths on the topside of hulls, gunwales or decks for proper mounting.
   (c) Fore and aft, a horizontal adjustment-
      1. accommodates hardware placement among already existing board hardware on the topside of a hull, gunwale or deck of a boat.
      2. slidably movable to accommodate the hardware placement on the topside of a hull, gunwale or deck.
      3. a boat owner can now have a choice of where to mount his boarding platform on his boat.
3. Objects of being portable
   (a) Folds up within its own framework.
   (b) Collapses in such a way that one can carry it in a suitcase manner.
   (c) Stores with an approx. thickness of $1\frac{3}{4}$ in.

4. A further object of the invention is an easy shelf-locking, quick release mounting and dismounting capability, providing ease of use even in rough seas.

5. Still another object of the invention is to direct the weight on the portable boarding platform toward the side of a boat hull, waterline area or transom having little downward strain from the top side of a hull, gunwale or deck.

6. Yet another object of the invention is the ability to mount and dismount the portable platform while the platform is inside of a boat, having control during different types of sea states. The platform is then swingable over the side of a boat.

7. A further object of the invention is to provide the boarding area with no protruding objects, structure design above the top of a hull, gunwale or transom other than normal size flat or circular marine boat hardware.

8. Another object of the invention is to provide a rigid construction and stable platform as on a permanent boarding platform.

9. Yet another object of our invention is to provide a portable ladder having a sturdy outboard position for easy access.

10. It is yet another object of the invention to allow the owner to angle the platform with an up angle, a down angle or being horizontal when the platform is in at or near the waterline.

Further objects and advantages of our invention will become apparent froma consideration of the drawings and ensuing description of it.

DRAWING FIGURES

Figure 1:
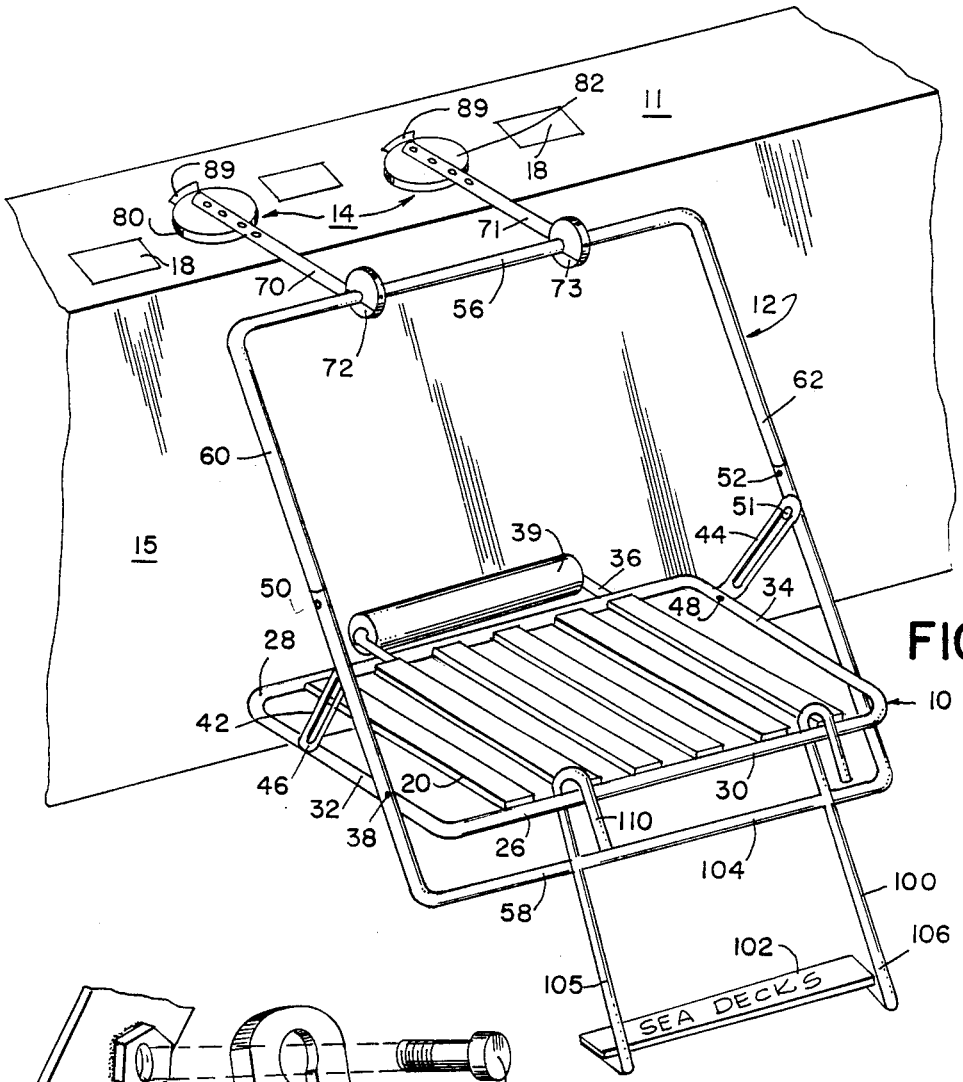
FIG. 1 Shows a perspective elevational front view of a completely extended and mounted Portable Platform with a Portable Ladder.

DRAWING REFERENCE NUMERALS:

15 Hull or Transom
10 Platform Section
11 Topside of Hull, gunwale or deck
12 Carrier Bar
14 Mounting Assembly
20 Planking
22 Flat Stock Front Side
24 Flat Stock Back Side
26 Tubular Frame of Platform Section
28 Back side of 26
30 Front side of 26
32 Left side of 26
34 Right side of 26
36 Padded Bumper Bar
39 Padding
23 Left Connection of 36
25 Right Connection of 36
27 Left Guide Clip of 36
29 Right Guide Clip of 36
37 Plurality of holes on 36
38 Left Clevis Pin connection
40 Right Clevis Pin connection
42 Left Side Pivotable Hinge
44 Right side Pivotable Hinge
46 Pivotable Hinge Connection At 32
48 Pivotable Hinge Connection at 34
49 Left Side Welded Nut and Screw Pin Connection on 60
51 Right Side Welded Nut and Screw Pin Connection on 62
56 Upper Section of Carrier Bar (Safety Hold Bar)
58 Lower Section of Carrier Bar (Waterline Hold Bar)
60 Left Telescopic Side Section of 12 (Safety Rails)
62 Right Telescopic Side Section of 12 (Safety Rails)
50 Ball-Lock Pin
52 Ball-Lock Pin
70 Hangar Bracket
71 Hangar Bracket
72 Two-Piece Bar Collar at Outboard End of 70
73 Two-Piece Bar Collar at Outboard End of 71
75 Plurality of Holes on 70 and 71
74 Notched Pins on 70 and 71
80 Self Locking Quick Release Deck Plate
82 Self Locking Quick Release Deck Plate
85 Upper Section of 80 and 82
87 Lower Section of 80 and 82
95 Through Holes for 74 on 80 and 82
89 Pivot Arm Inside 80 and 82
91 Spring Inside 80 and 82
93 Detent Pin Inside 80 and 82
97 Plate Screws for 80 and 82
100 Portable Ladder
105 Left Side of 100
106 Right Side Of 100
102 Wooden Step of 100
104 Welded Tubular Member Connecting 106 and 105
110 Hand Grips

DESCRIPTION

Figure 2:
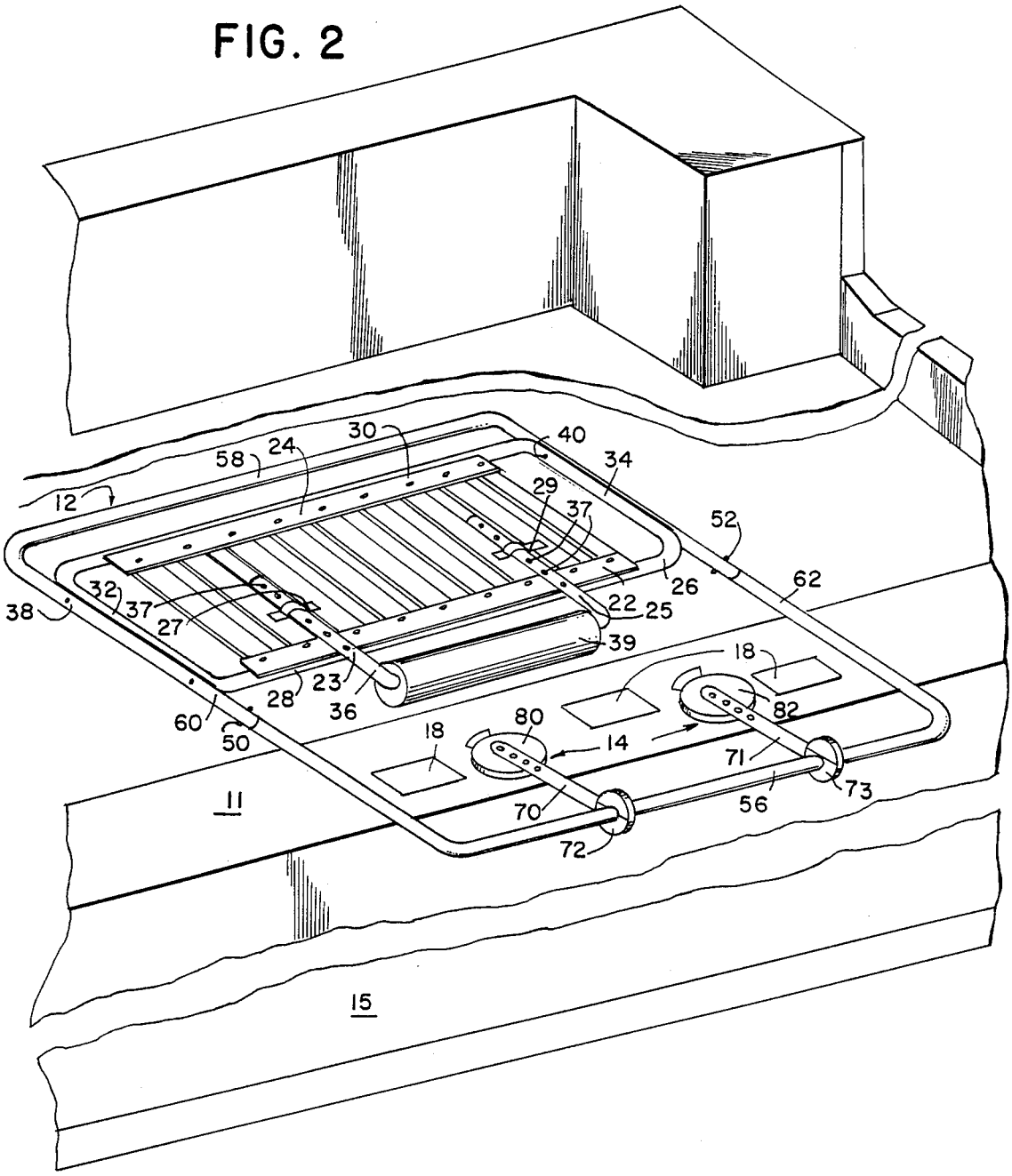
FIG. 2 Shows a perspective front elevational view of a folded up Portable Platform inside the boat and mounted.

FIG. 1 shows the invention mounted to the outboard side of a boat in its full extended position and FIG. 2 shows the same invention mounted without the portable ladder, only on the inside of a boat in the folded position. The base platform section 10 consists of spaced planking 20 preferably made of wood fastened or screwed to flat stock 22 and 24 which is welded to a rectangular tubular frame 26 being best seen in FIG. 2. This closed tubular frame 26 has a back side 28, a front side 30, a left side 32 and a right side 34. The flat stock 22 is welded flush at the bottom to the length of the back side 28 and the same for flat stock 24 being welded to the front side 30. Planking 20 is fastened to the flat stock 22 and 24 within the tubular frame 26, being flush with the top of tubular frame 26.

The base platform in FIG. 2 further includes a padded bumper bar 36 for resting up against the side of a boat hull 15 or boat transom 15 preventing scarring and abrasion. This bumper bar 36, an angular tubular member with sufficient marine use padding 39 is connected at 23 and 25 and made steady with guide clips 27 and 29 to the underside of the base platform 10. The bumper bar in FIG. 2 has a plurality of holes 37 for the outboard platform angle adjustment to the various hull angles of boats.

The base platform section 10 is hingedly connected to a supporting carrier bar 12. The carrier bar is hinged to the outside and toward the front portion 38 and 40 of the left side 32 and right side 34 of the platform's tubular frame 26. The hinge unit is a clevis pin and washer or other suitable fastener.

Figure 3:
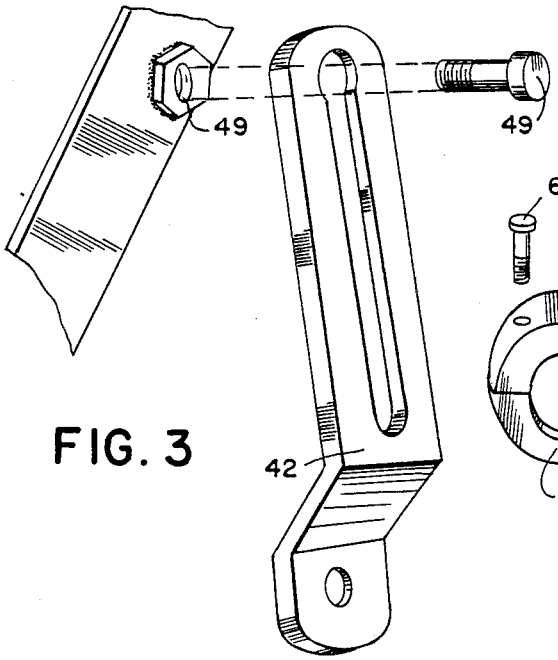
FIG. 3 Shows a perspective sectional view of the Pivotable Hinge.
Figure 4:
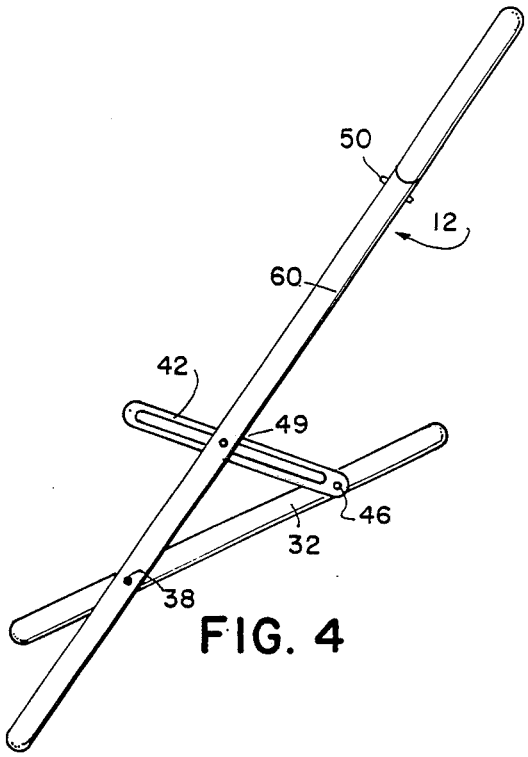
FIG. 4 Shows a side view of the hinging function and folding capability of the portable platform.

In FIG. 1, Pivotable hinges 42 and 44 are connected to the outside back portions 46 and 48 of the left and right sides 32 and 34 of the tubular frame 26. The opposite ends of pivot hinges 42 and 44 being best seen in FIG. 3 and FIG. 4 are slidably connected to a welded nut and screw pin 49 and 51 on the telescopic side sections 60 and 62 of the carrier bar. This hinge connection allows the platform to lock open and fold up within the framework of the carrier bar section 12 when storing.

The carrier bar section 12 is a rectangular tubular frame, telescopically engaged, used to support and adjust the vertical distance of the base platform 10 to the side of the a boat hull or boat transom. The carrier bar has an upper portion 56, a lower portion 58, a left side 60 and a right side 62. The left and right sides are telescopically engaged safety rails. The lower portion 58 provides the waterline hold bar. The upper portion 56 is the safety hold bar.

The telescopic vertical adjustments of sides 60 and 62 with a plurality of holes on the inside tubes are secured by thru-hole pins 50 and 52, a ball lock type of pin.

Figure 5:
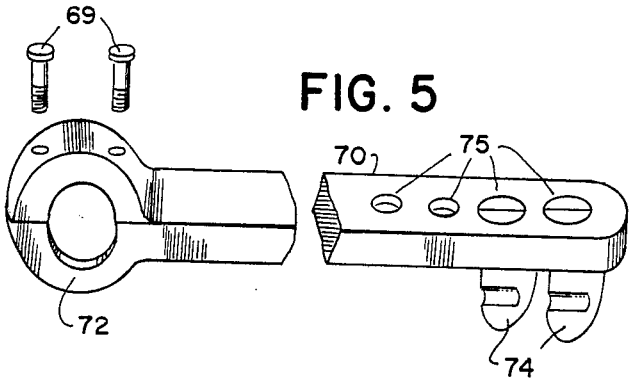
FIG. 5 Shows a perspective view of the casted Hangar Bracket with the Two-Piece Bar Collar outboard end and the inboard end with Notched Pins.

The upper portion 56 of the carrier bar 12 in FIG. 1 is connected to a pair of stainless steel casted hangar brackets 70 and 71 of the mounting assembly 14 by means of the outboard ends two-piece bar collars 72 and 73. In FIG. 5, this type of connection provides the swingable movement of the portable platform from the inside and outside of the boat and also provides pressure control over wing movement with screws 69.

These connecting collars 72 and 73 further provide the necessary movement needed to swing the weight on the base platform section 10 directly against the side of a boat hull 15 of transom, putting less downward hanging strain from the topside of a hull, gunwale or deck 11 of a boat.

These bar collar ends further provide a slidably moveable connection for horizontal adjustments when mounting the portable platform to the topside of a hull, gunwale or deck of a boat.

In FIG. 5, the opposite ends of the hangar brackets 70 and 71 have a plurality of holes 75 to adjust the insertible pins 74 providing outboard adjustments and for different size gunwale widths of different boat manufacturers.

Figure 6:
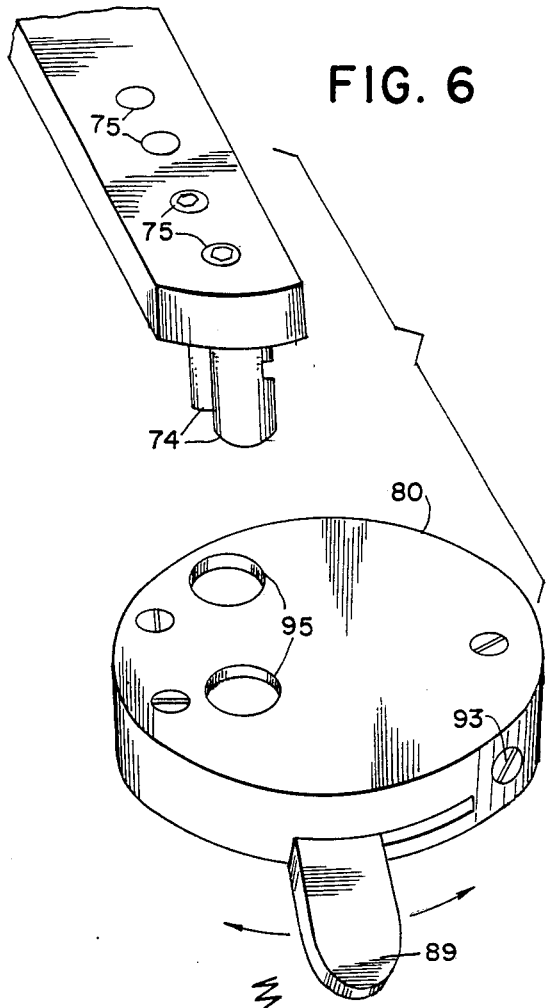
FIG. 6 Shows an elevational perspective view of the locking connection of the Mounting Assembly with Hangar Bracket and Self Locking Quick Release Plate.
Figure 7:
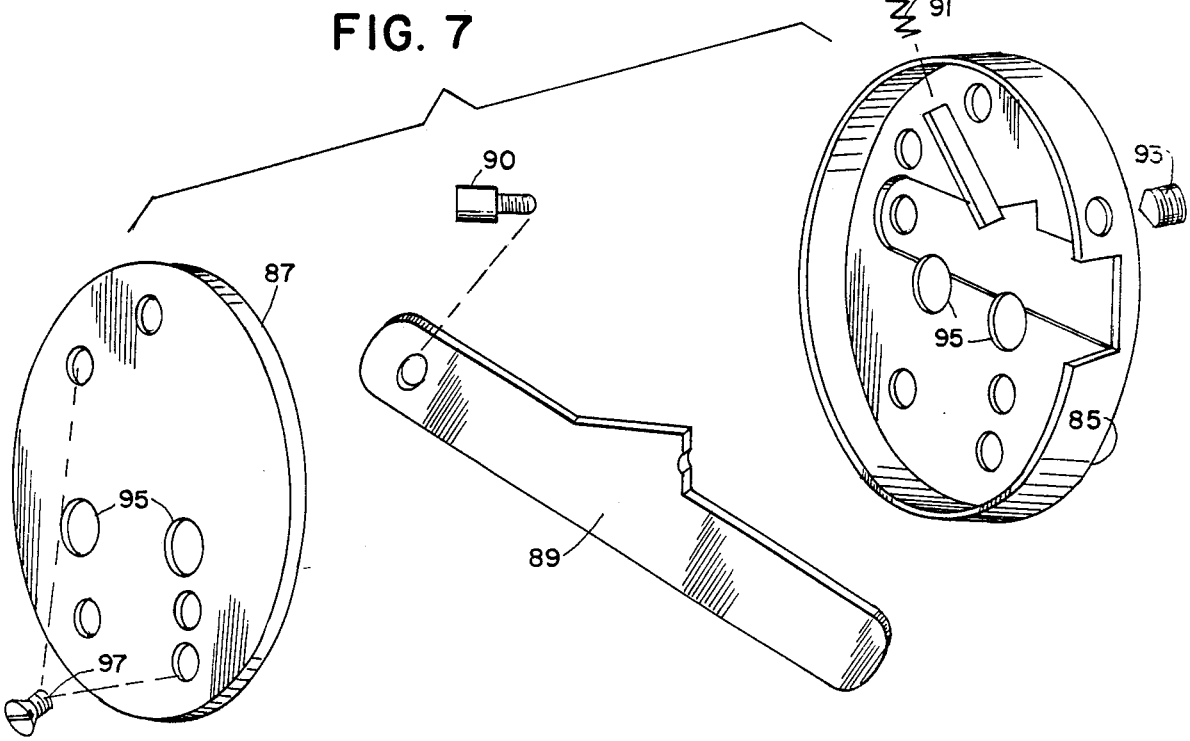
FIG. 7 Shows a perspective view of the Self Locking Quick Release Plate with internal parts.

These notched pins 74 in FIG. 5 and FIG. 6 of hangar brackets 70 and 71 are insertibly engaged into holes 95 on the self locking, quick release plates 80 and 82 that are fixed to the topside of a boat hull, gunwale or deck.

These Automatic locking plates 80 and 82 consist of an upper section 85, a lower section 87, holes 95, extending through the plate for insertible notched pins 74. Also, an internal pivot arm 89 with an externally extended lever engaging and disengaging the insertible notched pins 74, its pivot pin 90, a spring 91, detent pins 93 for holding the its pivot pin 90, a spring 91, detent pins 93 for holding the pivot arm in an unattended disengaged position relative to the insertible notched pins 74 and plate screws 97 for holding together the assembly of the locking plates.

With this means for mounting, a double horizontal adjustment is accomplished first by placing the locking plates fixedly to the free space available on the topside of a hull, gunwale or deck of a boat, a boater's choice among the already existing boat hardware 18 and then sliding the hangar brackets with bar collar connections along the upper section of the carrier bar to stop perpendicular to the locking plates in order to engage with the insertible pins automatically.

This flexible mounting Assembly 14 more easily seen in FIG. 5 and FIG. 6 provides boaters a much needed ease of use for a self-locking, quick-release and adjustable means for mounting and dismounting a portable boarding platform.

Figure 8:
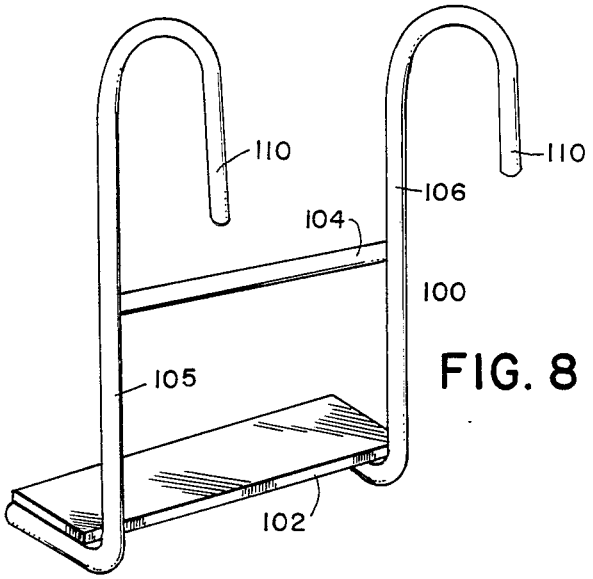
FIG. 8 Shows A perspective view of the portable Ladder.

In FIG. 8, a portable ladder 100 has a pair of angular tubular members 105 and 106 that are connected by a wooden step 102 and a welded tubular member 104 for stability. This ladder is freely yet securely attached between planking 20 and supported by the front side 30 of the platform section 10 and resting slightly outwardly on the lower section 58 of the carrier bar. The upper supporting angular curve of the ladder is extended further to provide hand grips 110 for easy access to the platform in a more safer stable manner.

Operation of Portable Platform

In this way, a platform section having planking smoothly attached within a stainless steel tubular frame is articulated to a carrier bar section having a stainless steel tubular frame telescopingly engaged at the sides for vertical adjustments.

These sections are joined in such a way as to provide the platform section to foldup within the collapsing carrier bar achieving single tube thickness for storing in a small space.

This portable boarding platform is attached to the side of a boat by means of a self locking, quick release mounting assembly. This assembly is made up of a pair of hangar brackets and a pair of locking plates. These hanger brackets have at the outboard ends a two piece bar collar that attaches to the upper portion of the carrier bar having a swinging motion.

The inboard portion of the insertibly notched pins can adjust the outboard distance of the platform, thru a plurality of holes along the center of the hanger brackets.

This pair of hanger brackets with insertible pins engage a pair of spring loaded locking plates that are attached to the topside of a hull, gunwale or deck of a boat. These locking plates have a quick release lever for disengaging the pins when dismounting the platform.

This mounting and dismounting assembly provides immediate attachment automatically locking the portable boarding platform to the boat, whereby, one can mount this platform from inside the boat and then swing it over the side to rest up against the side of the hull.

The swingable motion provided by the two piece bar collar ends and the angle of the carrier bar directs the weight on the platform against the side of the hull, releasing less hanging strain on the boat's gunwale or deck.

A portable ladder is also freely attached to the platform between planking for gaining access from the water.

The unique design of the carrier bar provides the following features while in operation:

(1) the lower portion becomes the hold bar for swimmers, divers, and skiers for staying at or near the boat, (2) telescopic sides are hand rails for pulling oneself upon the platform and also safety rails to prevent one from accidentally falling off the platform, (3) The top portion is the safety hold bar for maintaining balance and stability while on the platform and gaining access to and from the boat, (4) and with the portable ladder freely attached, one can step up and pull up simultaneously from the water similiar to the functionality of a ladder.

The invention is designed to provide attachment to different boat designs producing three dimensional adjustments of:

(1) horizontal or fore and aft, (2) vertical, (3) outboard or depth.

Figure 9:
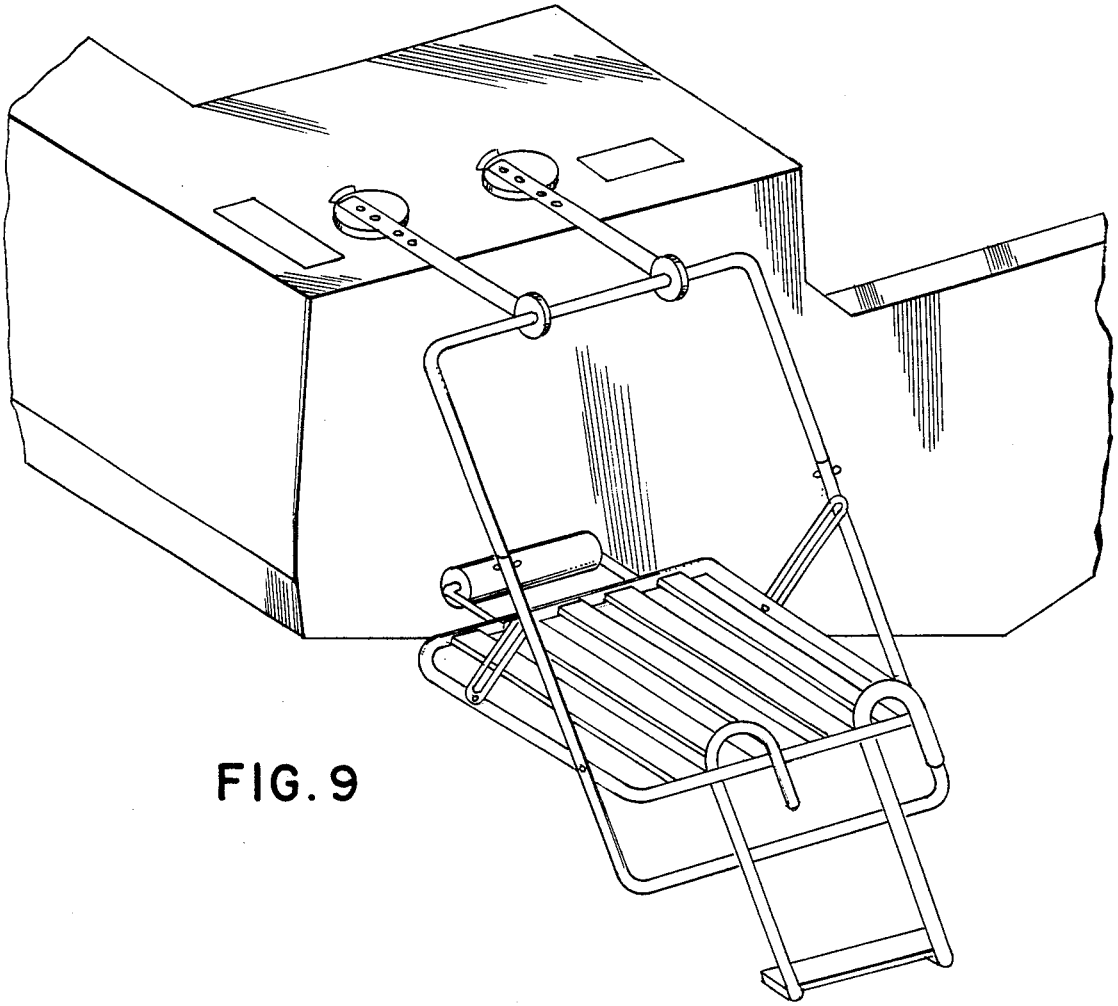
FIG. 9 Shows a perspective elevational view of a scaled down version of a Portable Platform, another preferred embodiment.

Another preferred embodiment of our invention would be the scaling down of all section sizes and produce a smaller portable platform or a ladder combined with a platform having a removable step for the sides of boats and boat transoms as shown in FIG. 9.

Thus the reader will see that this portable boarding platform invention provides a highly reliable, lightweight, yet much needed economical device which can be used by boatowners of different boat types, creating a new standard for the Marine Industry. While our above description contains many specificities, these should not be ocnstrued as limitations on the scope of the invention, but rather as an exemplifications of one preferred embodiment thereof. Many other variations are possible. For example, mounting assemblies can attach on, over, through and to the inside portion of the topside of a hull, gunwale or deck of a boat. Locking devices can be different internally or separately such as straight sliding key shafts locking to pins, bars or hooks and becoming non-automatic. There can also be hangar brackets having different clamping characteristics that will or will not be swingable to an outboard platform support bar. There can also be different hinging capabilities that can connect a platform to a support bar being either self actuating or manually operated and having a different folding capacities. There can also be different sizes and materials such as the new hard plastics that can be used to make the invention larger, smaller more lightweight and even permanently attaching to the side of a boat hull or boat transom.

Accordingly, the scope of the invention should be determined not by the embodiments illustrated, but by the appended claims and their legal equivalents.

We claim:

1. A portable boarding platform for the side of a boat hull or boat transom comprising, (a) A base platform defined by a rectangular tubular frame having a front section with a flat bar fixidly attached to its length, a back section having a second flat bar fixidly attached to its length, a first side section and a second side section, said side sections are shorter than said front and back sections, fixed planking spanning the distance between front and back sections, and (b) a carrier bar defined by a rectangular tubular member having a top section, a bottom section and telescopically engaged first and second side sections with thru hole pins, whereby said carrier bar provides the support and adjusts the vertical distance of said base platform to the side of the boat hull or boat transom, and (c) said base platform at the front portion of the first and second side sections are hingedly connected to the telescopic side sections of said carrier bar, a further connection is on the back portion of the side sections of said base platform being a pivotable hinge with its opposite ends attaching and being slidably locked to the pin connections on the telescopic side sections of said carrier bar, whereby said base platform is folded and unfolded within the framework of said carrier bar for convenient storage purposes, (d) means for mounting and dismounting portable platform to the side of a boat hull or boat transom including a self locking, quick release assembly having adaptability to various boat designs of different boat manufacturers.

2. The invention of claim 1 wherein said carrier bar and said means for mounting provides three dimensional adaptability having horizontal or fore & aft, vertical and outboard or depth adjustments for the attachment to various boat designs.

3. The invention of claim 1 wherein said base platform is smoothly rounded at the corners and planking is within the tubular framework and being flush or slightly recessed to the topside of the tubular frame.

4. The invention of claim 1 wherein said base platform section further including an angular tubular padded bumper bar, allowing the portable platform to rest up against the side of a boat hull or boat transom.

5. The invention of claim 4 wherein said bumper bar can be adjusted to the hull angle of a boat.

6. The invention of claim 4 wherein said bumper bar has padding made of a resilient material.

7. The portable boarding platform according to claim 1 wherein said means for mounting and dismounting the portable platform includes a self locking, quick release assembly having a pair of locking deck plates fixedly attached to the topside of a boat hull, gunwale or deck and a pair of hanger brackets employing insertible notched pins for engaging and disengaging said locking plate.

8. The portable boarding platform as defined in claim 7 wherein said locking plates being fixidly attached to the free space available between the boat's already existing hardware on the topside of a hull, gunwale, or deck of a boat whereby the portable platform can be mounted to a desired location at the side of a boat hull or boat transom.

9. The invention as defined in claim 8 wherein said locking plates will attach to a fixed position on the width, space and configuration allowed on the topside of a hull, gunwale or deck of a boat.

10. The invention as defined in claim 7 wherein said hangar brackets have outboard adjustments with a plurality of holes for the placement of the insertible notched pins, whereby said means for mounting further accomodates the different widths and space available on the topside of hulls, gunwales or decks of boats.

11. The invention as defined in claim 7 wherein said hangar brackers have a two piece bar collar configuration at the outboard ends connecting to the top section of said carrier bar, whereby the portable platform is connected to said means for mounting and dismounting.

12. The invention as defined in claim 11 wherein said hangar brackets with bar collar ends attaching to the top section of said carrier bar being a swingably movable connection, whereby the portable platform can freely swing over the topside of a hull, gunwale or deck of a boat.

13. The invention as defined in claim 12 wherein said hangar brackets with swingably movable bar collar connections allows for mounting and dismounting the portable platform from inside the boat, whereby a safe, controlled condition exists in rolling seas.

14. The invention as defined in claim 12 wherein said hangar brackets with bar collar connections is also slidably movable along the top section of said carrier bar accomodating the fixed position of said locking plates enabling said hangar brackets with insertible notched pins to engage said locking plates at a perpendicular angle, whereby further accomodating the means for mounting and dismounting the portable platform at a desired location at the side of a boat hull or boat transom.

15. The invention as defined in claim 12 wherein the hangar brackets with the swingable movement of the bar collar and the angle of the carrier bar provides the movement needed to swing the weight on the platform directly against the side of a boat hull or boat transom, whereby the weight puts less downward hanging strain on the topside of a hull, gunwale or deck of a boat.

16. A portable boarding platform combined with a self locking, quick release mounting assembly for the side of a boat hull or boat transom comprising, (a) a base platform defined as rectangular in shape, having a tubular metal frame with fixed planking, (b) a carrier bar defined as rectangular in shape, having a tubular frame telescopically engaged at side sections with thru hole pins, providing vertical adjustments and support for said base platform, (c) means for hinging said base platform to said carrier bar including the platforms ability to fold and unfold within the framework of said carrier bar providing single tube thickness, (d) a self locking, quick release mounting assembly defined as a pair of casted hangar brackets having a two piece bar collar configuration at one end and adjustable insertible notched pins toward the opposite end, a pair of self-locking plates that fixidly attach to the topside of the hull, gunwale or deck of the boat, said locking plates have an upper section, a lower section, an internal spring loaded slidable pivoting arm section with an extended external lever, a detent pin for holding the pivot arm section in an unattended disengaged position relative to the insertible notched pins and two holes passing through said upper and lower sections, whereby said hangar brackets with insertible notched pins penetrates said holes becoming locked in place automatically when said internal pivot section springably engages the notched pins and when the external lever is moved and held unattended by the detent pin, the pivot arms are disengaged from the insertible notched pins for a quick release removal.

17. A portable boarding platform combined with a portable ladder for the side of a boat hull or boat transom comprising, (a) a base platform section, rectangular in shape having a tubular frame with fixed planking (b) a carrier bar section, rectangular in shape, having a tubular framework telescopically engaged at its side sections with thru hole pins for adjusting vertical movement and supporting said base platform, (c) means for articulating said base platform section to said carrier bar whereby the platform folds up within the framework of the carrier bar, (d) means for mounting the portable platform to the topside, gunwale or deck of the boat including a self locking, quick release device, (e) a portable ladder defined as two angular tubular members with lower portions angled inwardly towards the boat hull or transom for planking to be fixedly attached thereto, thereby forming a foot step, and the upper portions of the angular tubular members are curved with a tight radius such that being inserted upwardly between planking at a front section of said base platform and swung downward to rest on a lower section of said carrier bar, both members are connected about midway by a third tubular member for stability.

18. A portable boarding platform according to claim 17 wherein said portable ladder has extending tubular hand grips to grab on to when accessing the ladder to the platform.

19. A portable boarding platform according to claim 17 wherein said portable ladder is angled slightly outwardly away from the boat hull or boat transom, whereby accessibility to the ladder becomes effortless.

20. A portable boarding platform in accordance with claim 17 wherein said portable ladder connects freely to the platform in a stable position.

* * * * *